US006257577B1

(12) United States Patent
Sutton

(10) Patent No.: US 6,257,577 B1
(45) Date of Patent: Jul. 10, 2001

(54) GAME OF CRIBBAGE AND METHOD OF PLAYING THE SAME

(76) Inventor: Nancy H. Sutton, 612 N Cascade Dr. Space #70, Woodburn, OR (US) 97071

( * ) Notice: Subject to any disclaimer, the term of this patent is extended or adjusted under 35 U.S.C. 154(b) by 0 days.

(21) Appl. No.: 09/653,842

(22) Filed: Sep. 1, 2000

(51) Int. Cl.[7] ..... A63F 3/00
(52) U.S. Cl. ..... 273/246; 273/248
(58) Field of Search ..... 273/248, 246, 273/249; D10/46.1; 235/90

(56) References Cited

U.S. PATENT DOCUMENTS

| | | | | |
|---|---|---|---|---|
| D. 141,449 | * | 6/1945 | McGonigle . | |
| D. 251,078 | * | 2/1979 | Eriksen | D34/5 |
| D. 375,762 | | 11/1996 | Meunier . | |
| 711,854 | * | 10/1902 | Harton . | |
| 780,937 | | 1/1905 | Clagett . | |
| 1,583,488 | | 5/1926 | Pauer . | |
| 3,185,481 | * | 5/1965 | Watkins . | |
| 3,520,536 | * | 7/1970 | Kindelan . | |
| 3,690,666 | | 9/1972 | Seitz . | |
| 4,057,254 | * | 11/1977 | Girres | 273/134 |
| 5,092,605 | * | 3/1992 | Hoffman | 273/246 |
| 5,126,717 | * | 6/1992 | Renaud et al. | 340/323 |
| 5,226,655 | * | 7/1993 | Rickabaugh | 273/246 |
| 5,240,249 | * | 8/1993 | Czarnecki et al. | 273/85 |
| 5,498,005 | * | 3/1996 | Jacques | 273/248 |
| 5,590,883 | | 1/1997 | Brewer . | |
| 5,653,443 | * | 8/1997 | Ervin | 273/248 |
| 5,810,359 | * | 9/1998 | Wilkins et al. | 273/256 |

* cited by examiner

*Primary Examiner*—Sebastiano Passaniti

(57) ABSTRACT

A game of cribbage and method of playing the same for adding an additional element of strategy to cribbage. The game of cribbage and method of playing the same includes a game board having a plurality of predetermined positions defining parallel scoring tracks. Each of the predetermined positions comprises a hole extending into the game board. Each of the tracks is generally circular. The tracks are divided into a plurality of sections each of the sections having a plurality of predetermined positions therein. Each of the sections has a first position. A plurality of action indicia radially extends from a central portion of the game board. Each of the action indicia extends toward and acts upon one of the first positions. A deck of cards and a plurality of pairs of pegs are used for playing conventional cribbage. Players play according to the rule of cribbage but follow the action indicia when a peg lands in one of the first positions. The player to first complete the scoring track wins the game.

9 Claims, 2 Drawing Sheets

GAME OF CRIBBAGE AND METHOD OF PLAYING THE SAME

BACKGROUND OF THE INVENTION

1. Field of the Invention

The present invention relates to cribbage games and more particularly pertains to a new game of cribbage and method of playing the same for adding an additional element of strategy to cribbage.

2. Description of the Prior Art

The use of cribbage games is known in the prior art. More specifically, cribbage games heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,590,883; U.S. Pat. No. 3,690,666; U.S. Des. Pat. No. 375,762; U.S. Pat. No. 780,937; and U.S. Pat. No. 1,583,488.

While these devices fulfill their respective, particular objectives and requirements, the aforementioned patents do not disclose a new game of cribbage and method of playing the same. The inventive device includes a game board having a plurality of predetermined positions defining parallel scoring tracks. Each of the predetermined positions comprises a hole extending into the game board. Each of the tracks is generally circular. The tracks are divided into a plurality of sections each of the sections having a plurality of predetermined positions therein. Each of the sections has a first position. A plurality of action indicia radially extends from a central portion of the game board. Each of the action indicia extends toward and acts upon one of the first positions. A deck of cards and a plurality of pairs of pegs are used for playing conventional cribbage. Players play according to the rule of cribbage but follow the action indicia when a peg lands in one of the first positions. The player to first complete the scoring track wins the game.

In these respects, the game of cribbage and method of playing the same according to the present invention substantially departs from the conventional concepts and designs of the prior art, and in so doing provides an apparatus primarily developed for the purpose of adding an additional element of strategy to cribbage.

SUMMARY OF THE INVENTION

In view of the foregoing disadvantages inherent in the known types of cribbage games now present in the prior art, the present invention provides a new game of cribbage and method of playing the same construction wherein the same can be utilized for adding an additional element of strategy to cribbage.

The general purpose of the present invention, which will be described subsequently in greater detail, is to provide a new game of cribbage and method of playing the same apparatus and method which has many of the advantages of the cribbage games mentioned heretofore and many novel features that result in a new game of cribbage and method of playing the same which is not anticipated, rendered obvious, suggested, or even implied by any of the prior art cribbage games, either alone or in any combination thereof.

To attain this, the present invention generally comprises a game board having a plurality of predetermined positions defining parallel scoring tracks. Each of the predetermined positions comprises a hole extending into the game board.

Each of the tracks is generally circular. The tracks are divided into a plurality of sections each of the sections having a plurality of predetermined positions therein. Each of the sections has a first position. A plurality of action indicia radially extends from a central portion of the game board. Each of the action indicia extends toward and acts upon one of the first positions. A deck of cards and a plurality of pairs of pegs are used for playing conventional cribbage. Players play according to the rule of cribbage but follow the action indicia when a peg lands in one of the first positions. The player to first complete the scoring track wins the game.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new game of cribbage and method of playing the same apparatus and method which has many of the advantages of the cribbage games mentioned heretofore and many novel features that result in a new game of cribbage and method of playing the same which is not anticipated, rendered obvious, suggested, or even implied by any of the prior art cribbage games, either alone or in any combination thereof.

It is another object of the present invention to provide a new game of cribbage and method of playing the same which may be easily and efficiently manufactured and marketed.

It is a further object of the present invention to provide a new game of cribbage and method of playing the same which is of a durable and reliable construction.

An even further object of the present invention is to provide a new game of cribbage and method of playing the same which is susceptible of a low cost of manufacture with regard to both materials and labor, and which accordingly is then susceptible of low prices of sale to the consuming public, thereby making such game of cribbage and method of playing the same economically available to the buying public.

Still yet another object of the present invention is to provide a new game of cribbage and method of playing the same which provides in the apparatuses and methods of the prior art some of the advantages thereof, while simultaneously overcoming some of the disadvantages normally associated therewith.

Still another object of the present invention is to provide a new game of cribbage and method of playing the same for adding an additional element of strategy to cribbage.

Yet another object of the present invention is to provide a new game of cribbage and method of playing the same which includes a game board having a plurality of predetermined positions defining parallel scoring tracks. Each of the predetermined positions comprises a hole extending into the game board. Each of the tracks is generally circular. The tracks are divided into a plurality of sections each of the sections having a plurality of predetermined positions therein. Each of the sections has a first position. A plurality of action indicia radially extends from a central portion of the game board. Each of the action indicia extends toward and acts upon one of the first positions. A deck of cards and a plurality of pairs of pegs are used for playing conventional cribbage. Players play according to the rule of cribbage but follow the action indicia when a peg lands in one of the first positions. The player to first complete the scoring track wins the game.

Still yet another object of the present invention is to provide a new game of cribbage and method of playing the same that forces a player to better comprehend the positioning of their pegs and the positioning of the opponents pegs.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
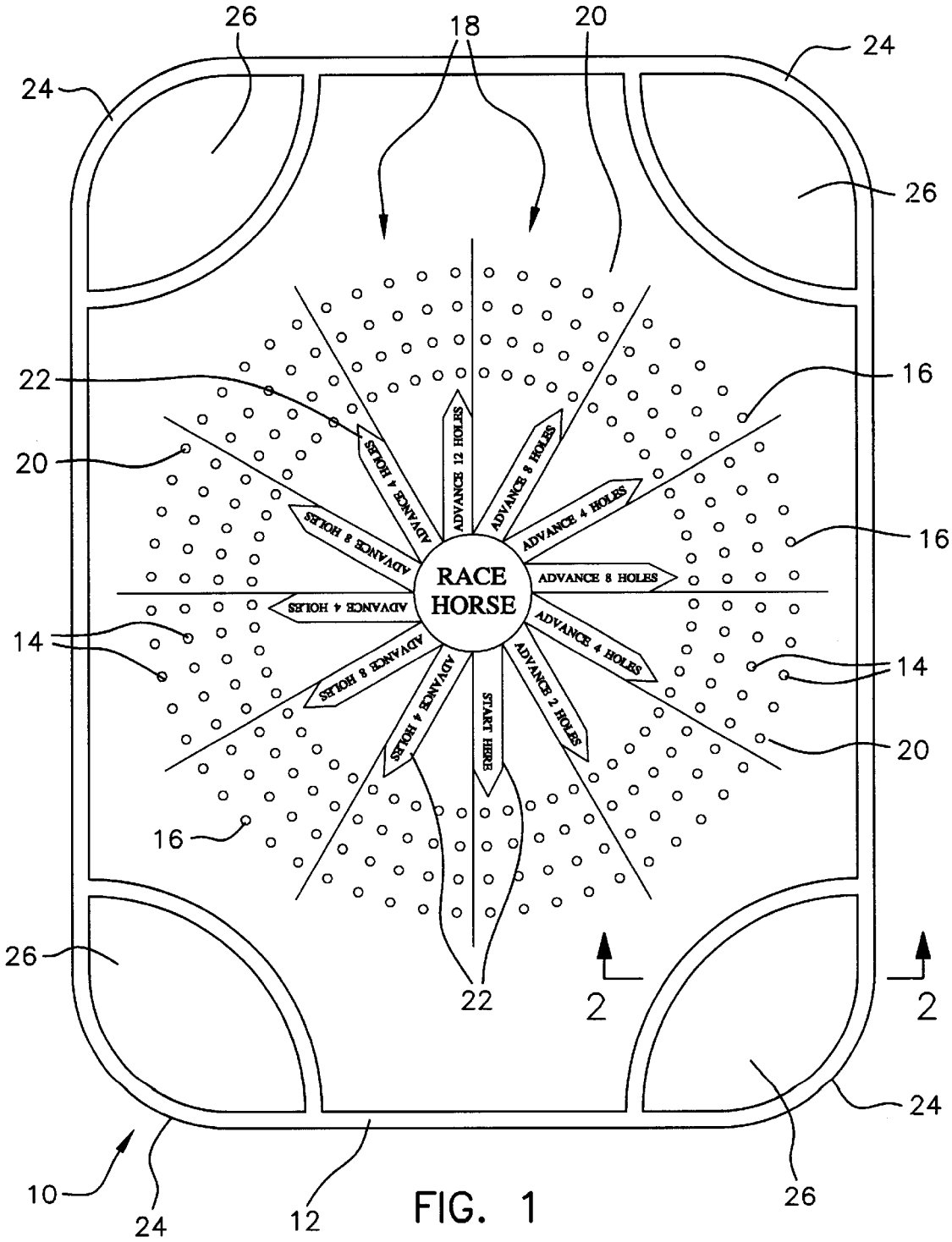
FIG. 1 is a schematic plan view of a game board of a new game of cribbage and method of playing the same according to the present invention.
Figure 2:
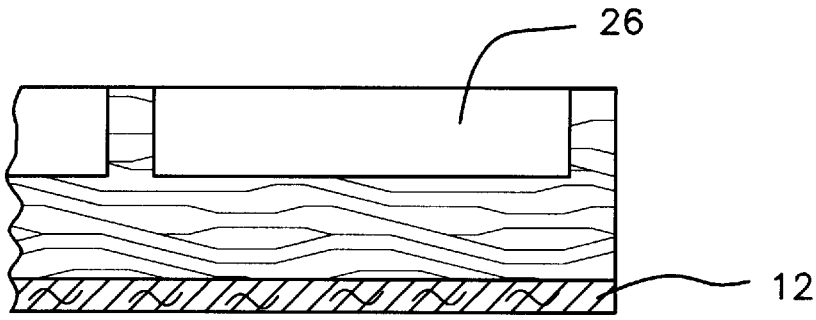
FIG. 2 is a schematic cross-sectional view taken along line 2—2 of the present invention.
Figure 3:
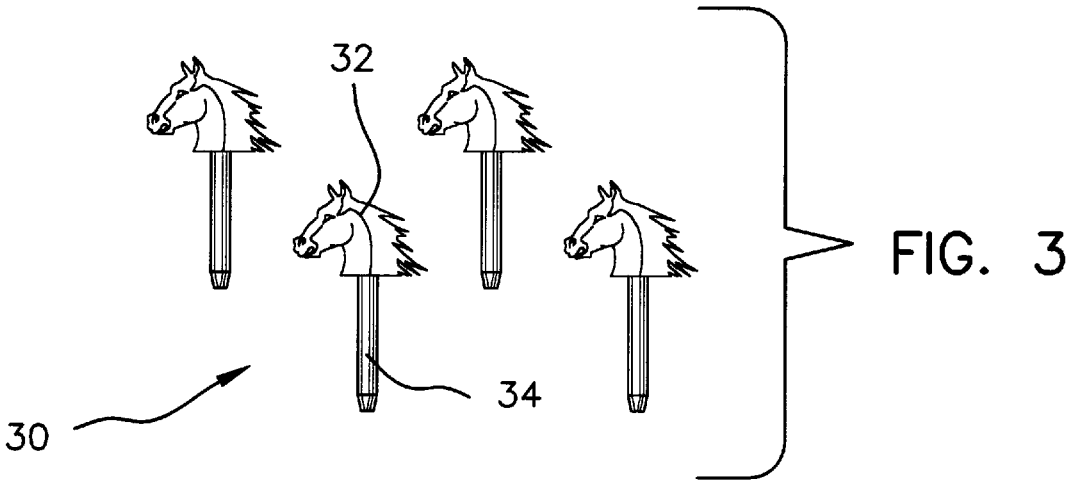
FIG. 3 is a schematic perspective view of pegs of the present invention.
Figure 4:
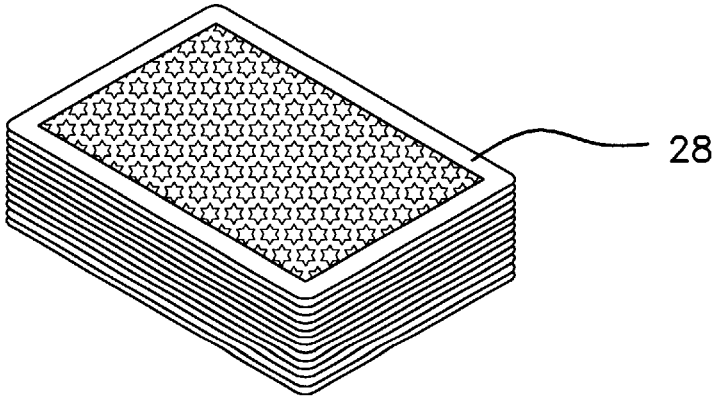
FIG. 4 is a schematic perspective view of a deck of cards of the present invention.

With reference now to the drawings, and in particular to FIGS. 1 through 4 thereof, a new game of cribbage and method of playing the same embodying the principles and concepts of the present invention and generally designated by the reference numeral will be described.

As best illustrated in FIGS. 1 through 4, the game of cribbage and method of playing the same 10 generally comprises a game board 12. The game board 12 has a plurality of predetermined positions defining parallel scoring tracks 14. Each of the predetermined positions comprises a hole 16 extending into the game board 12. Each of the tracks 14 is generally circular. Each of the tracks 14 preferably has sixty predetermined positions therein. Each of tracks 14 is divided into twelve sections 18. Each of the sections preferably has five predetermined positions therein. The sections 18 each have a first position 20. A plurality of action indicia 22 radially extends from a central portion of the game board. Each of the action indicia 22 extends towards and acts upon one of the first positions 20. The action indicia 22 is preferably selected from the group consisting of start here, advance 2 holes, advance 4 holes, advance 8 holes, and advance 12 holes. The game board 12 has a peripheral edge has a generally rectangular shape. The game board has generally arcuate corners 24. Four depressions 26 extend into the surface of the game board 12. Each of the depressions 26 is generally positioned adjacent to one of the corners 24. The plurality of scoring tracks 14 is ideally four scoring tracks. Each of the scoring tracks 14 has a different color preferably selected from the group consisting of red, green, yellow and blue.

A conventional deck of cards 28 is used and includes four suits of cards including spades, hearts, diamonds and clubs. Each suit includes an ace through ten, jack, queen and king.

A plurality of pairs of pegs 30 are used for movement about the game board. Each of the pegs 30 has a top portion 32 and a bottom portion 34. Each of the bottom portions 34 has a shape adapted to fitting in the holes 16. The top portions 34 each have a shape resembling a horse head. Each of the pairs has a color associated with one of the colors of the scoring tracks 14. The pegs 30 are stored in the depressions 26 in the game board 12 when not in use.

Each player chooses a pair of pegs 30 and a respectively colored scoring track.

The players play a conventional game of cribbage adapted to general rules whereby scoring is kept by moving the pairs of pegs 30 around the scoring track 14.

The difference of the cribbage game being found in the action indicia. The players follow the action indicia 22 when they land in one of the first positions 20. This adds additional strategy as players attempt to land their pegs in the first positions and attempt to prevent their opponents from doing so by the playing of cards.

The first player to complete the scoring path, as in conventional cribbage, wins the game. The advancement of the pegs from the first positions and the shape of the pegs simulates a horse race.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of playing a cribbage game comprising the steps of:

providing a game board, said game board having a plurality of predetermined positions defining parallel scoring tracks, each of said predetermined positions comprising a hole extending into said game board, each of said tracks being generally circular, each of tracks being divided into a plurality of sections, each of said sections having a plurality of predetermined positions therein, each of said sections having a first position such that the first position of each of said section of said scoring tracks are substantially aligned along a radial axis extending outwardly from a central portion of said game board, a plurality of action indicia radially extending from the central portion of said game board, each of said action indicia extending toward and acting upon one of said first positions;

providing a deck of cards;

providing a plurality of pairs of pegs, each peg being movable along the positions of one of said scoring tracks to indicate a current position of a player;

choosing a pair of pegs and a scoring track;

playing the game of cribbage using said deck of cards;

moving said pairs of pegs along said scoring track according to the rules of cribbage;

following said action indicia when landing in one of said first positions;

advancing over a number of positions as directed by said action indicia when landing on one of said first positions; and winning the game by a first player to move completely around the scoring path.

2. The method of playing a cribbage game according to claim 1, wherein the step of providing a game board further includes:

each of said tracks having sixty predetermined positions therein, each of tracks being divided into twelve sections such that each of said sections has five predetermined positions therein.

3. The method of playing a cribbage game according to claim 1, wherein the step of providing a game board further includes:

said action indicia being selected from the group consisting of start here, advance 2 holes, advance 4 holes, advance 8 holes, and advance 12 holes.

4. The method of playing a cribbage game according to claim 1, wherein the step of providing a game board further includes:

said game board having a peripheral edge having a generally rectangular shape, said game board having generally arcuate corners, four depressions extending into said surface of said game board, each of said depressions being generally positioned adjacent to one of said corners.

5. The method of playing a cribbage game according to claim 1, wherein the step of providing a game board further includes:

said plurality of scoring tracks being four scoring tracks, each of said scoring tracks having a different color.

6. The method of playing a cribbage game according to claim 5, wherein the step of providing a plurality of pairs of pegs further comprises:

each of said pegs having a top portion and a bottom portion, each of said bottom portions having a shape adapted to fitting in said holes, each of said top portions having a shape resembling a horse head, each of said pairs having a color associated with one of said colors of said scoring tracks.

7. The method of playing a cribbage game according to claim 1, wherein the step of providing a plurality of pairs of pegs further comprises:

each of said pegs having a top portion and a bottom portion, each of said bottom portions having a shape adapted to fitting in said holes, each of said top portions having a shape resembling a horse head, winning the game by a first player to move completely around the scoring path.

8. A method of playing a cribbage game comprising the steps of:

providing a game board, said game board having a plurality of predetermined positions defining parallel scoring tracks, each of said predetermined positions comprising a hole extending into said game board, each of said tracks being generally circular, each of said tracks having sixty predetermined positions therein, each of tracks being divided into twelve sections, each of said sections having five predetermined positions therein, each of said sections having a first position such that the first position of each of said section of said scoring tracks are substantially aligned along a radial axis extending outwardly from a central portion of said game board, a plurality of action indicia radially extending from the central portion of said game board, each of said action indicia extending toward and acting upon one of said first positions, said action indicia being selected from the group consisting of start here, advance 2 holes, advance 4 holes, advance 8 holes, and advance 12 holes, said game board having a peripheral edge having a generally rectangular shape, said game board having generally arcuate corners, four depressions extending into said surface of said game board, each of said depressions being generally positioned adjacent to one of said corners, said plurality of scoring tracks being four scoring tracks, each of said scoring tracks having a different color;

providing a deck of cards including four suits of cards including spades, hearts, diamonds and clubs, each suit including an ace through ten, jack, queen and king;

providing a plurality of pairs of pegs, each of said pegs having a top portion and a bottom portion, each of said bottom portions having a shape adapted to fitting in said holes, each of said top portions having a shape resembling a horse head, each of said pairs having a color associated with one of said colors of said scoring tracks;

choosing a pair of pegs and a respectively colored scoring track;

playing the game of cribbage using said deck of cards;

moving said pairs of pegs along said scoring track according to the rules of cribbage;

following said action indicia when landing in one of said first positions; advancing over a number of positions as directed by said action indicate when landing on one of said first positions; and winning the game by a first player to move completely around the scoring path.

9. A cribbage game comprising:

a game board, said game board having a plurality of predetermined positions defining parallel scoring tracks, each of said predetermined positions comprising a hole extending into said game board, each of said tracks being generally circular, each of said tracks having sixty predetermined positions therein, each of said tracks being divided into twelve sections, each of said sections having five predetermined positions therein, each of said sections having a first position, a plurality of action indicia radially extending from a central portion of said game board, each of said action indicia extending toward and acting upon one of said first positions;

a deck of cards including four suits of cards including spades, hearts, diamonds and clubs, each suit including an ace through ten, jack, queen and king;

a plurality of pairs of pegs, each of said pegs having a top portion and a bottom portion, each of said bottom portions having a shape adapted to fitting in said holes, each of said top portions having a shape resembling a horse head, each of said pairs having a color associated with one of said colors of said scoring tracks;

wherein said players play the game of cribbage using said deck of cards, move said pairs of pegs along said scoring track according to the rules of cribbage and follow said action indicia when landing in one of said first positions.

* * * * *